United States Patent [19]

Gerken

[11] 4,401,033

[45] Aug. 30, 1983

[54] COUNTER-ROTATING TROLLEY AND TRACK SUSPENSION SYSTEM

[75] Inventor: Carl F. Gerken, New Castle, Ind.

[73] Assignee: American Standard Inc., New York, N.Y.

[21] Appl. No.: 272,405

[22] Filed: Jun. 10, 1981

[51] Int. Cl.[3] ..... E05D 13/02

[52] U.S. Cl. ..... 104/94; 104/111; 16/89; 16/95 R; 16/106; 49/409

[58] Field of Search ..... 104/94, 111; 16/89, 16/91, 95, 96 R, 87 R, 87.4 R, 88, 97, 103, 104, 105, 106, 107; 49/127, 409, 411

[56] References Cited

U.S. PATENT DOCUMENTS

| | | | |
|---|---|---|---|
| 3,042,960 | 7/1962 | Spork | 16/89 |
| 3,091,189 | 5/1963 | Becker | 104/94 |
| 3,879,799 | 4/1975 | Williams | 104/94 |
| 3,929,078 | 12/1975 | Sears | 104/111 |
| 4,084,289 | 4/1978 | Naimo | 16/87 R |
| 4,141,106 | 2/1979 | Dixon | 16/89 |
| 4,159,556 | 7/1979 | Dickson | 16/87.4 R |

*Primary Examiner*—Robert B. Reeves

*Assistant Examiner*—Richard G. Mathieu

*Attorney, Agent, or Firm*—James J. Salerno, Jr.; Robert G. Crooks; John P. Sinnott

[57] ABSTRACT

A self-plumbing, counter-rotating trolley and track suspension system for supporting an operable wall panel is disclosed. The suspension system comprises a trolley assembly, including a pendant bolt to provide a common axle on which a pair of counter-rotating discs are rotatably mounted in spaced apart alignment. The track-contacting surface of each disc is spherically formed, with each surface generated from a common centerpoint but having unequal radii so that the surfaces generated by the radii have curvatures which are similar but are not congruent. The suspension system also includes a track having a pair of vertically spaced and diametrically arranged rails, each rail defining a cylindrical surface which is generated from the same common centerpoint of that of the discs, the locus of which lies above the rail-contacting surface of the upper disc. When the trolley is mounted for movement along the track, the discs of the trolley will always maintain mating contact with their respective rails, even when the center line of the trolley and track are in misalignment.

5 Claims, 6 Drawing Figures

COUNTER-ROTATING TROLLEY AND TRACK SUSPENSION SYSTEM

BACKGROUND OF THE INVENTION

1. Field of the Invention

This invention relates to an improved, counter-rotating trolley and track suspension system for supporting an operable wall panel. The trolley and track suspension system is self-plumbing so that if there is any misalignment along the axial center line of the suspension system, the trolley assembly will always be in mating contact with the corresponding rails of the track.

2. Prior Art

Various designs of trolley and track assemblies of the counter-rotating type are known. In U.S. Pat. No. 3,042,960, a counter-rotating trolley and track assembly is disclosed. However, the rails of the track and the contacting surfaces of the rotating discs are in the horizontal plane so that any misalignment between the trolley and track assembly along its axial center line will cause one of the discs to shift away from mating contact with its corresponding rail, thereby placing the entire load on the other disc. In U.S. Pat. No. 3,879,799, a multidirectional, self-centering, suspension system is disclosed. Both the rotating discs of the trolley and the corresponding track rails are formed having frustoconical cone surfaces so that the counter-rotating discs will always be centered. However, should there be any misalignment relative to the track and trolley assemblies along its axial center line, one of the discs will be shifted away from the corresponding track surface, causing the entire load to be shifted to the other rotating disc. In U.S. Pat. No. 4,141,106, a canted wheel carrier for supporting an operable wall is disclosed. The canted wheel assembly is arranged and constructed to negotiate angle turns or intersections without the necessity for using switching devices or curved supporting surfaces. The assembly is not self-plumbing so that any misalignment between the track and wheel carrier would cause the load to be shifted to a single wheel. U.S. Pat. No. 4,159,556 discloses a suspension system which is capable of moving along a track and negotiating a junction, such as an intersection, without dislodgment of the trolley from the track. The trolley and track assembly is not self-plumbing since any misalignment of the trolley with respect to the track along its axial center line would cause contact of the supporting plates of the trolley with the interior surfaces of the track.

SUMMARY OF THE INVENTION

It is an object of the invention to provide a self-plumbing, counter-rotating trolley and track suspension system for supporting an operable wall panel.

Another object of the invention is to provide contacting surfaces between the rails of the track and counter-rotating discs of the trolley which, when mated together, form, respectively, an arcuate line contact, the respective arcs being generated from a common centerpoint but having unequal radii so that the arcs generated by the radii have curvatures which are similar but are not congruent.

Another object of the invention is to provide a counter-rotating trolley and track suspension system in which the counter-rotating discs will maintain contact with their corresponding rails even where misalignment of the trolley and track assemblies occurs along the center line of the system.

Another object of the invention is to provide a relatively inexpensive, simple to manufacture, and easy to install counter-rotating trolley and track assembly for operable wall panels.

The invention generally contemplates providing a self-plumbing, counter-rotating trolley and track suspension system for supporting an operable wall panel. The suspension system comprises a trolley assembly, including a pendant bolt, to provide a common axle on which a pair of counter-rotating discs are rotatably mounted in spaced apart alignment. The track-contacting surface of each disc is spherically formed with each surface generated from a common centerpoint but having unequal radii so that the surfaces generated by the radii have curvatures which are similar but are not congruent. The suspension system also includes a track having a pair of vertically spaced and diametrically arranged rails, each rail defining a cylindrical surface which is generated from the same common centerpoint of that of the discs. The locus of the common centerpoint lies along the axial center line of the system above the rail-contacting surface of the upper disc. When the trolley is mounted for movement along the track, the discs of the trolley will always maintain mating contact with their respective rails, even when the center line of the trolley and the track are in misalignment.

DESCRIPTION OF THE PREFERRED EMBODIMENT

Figure 1:
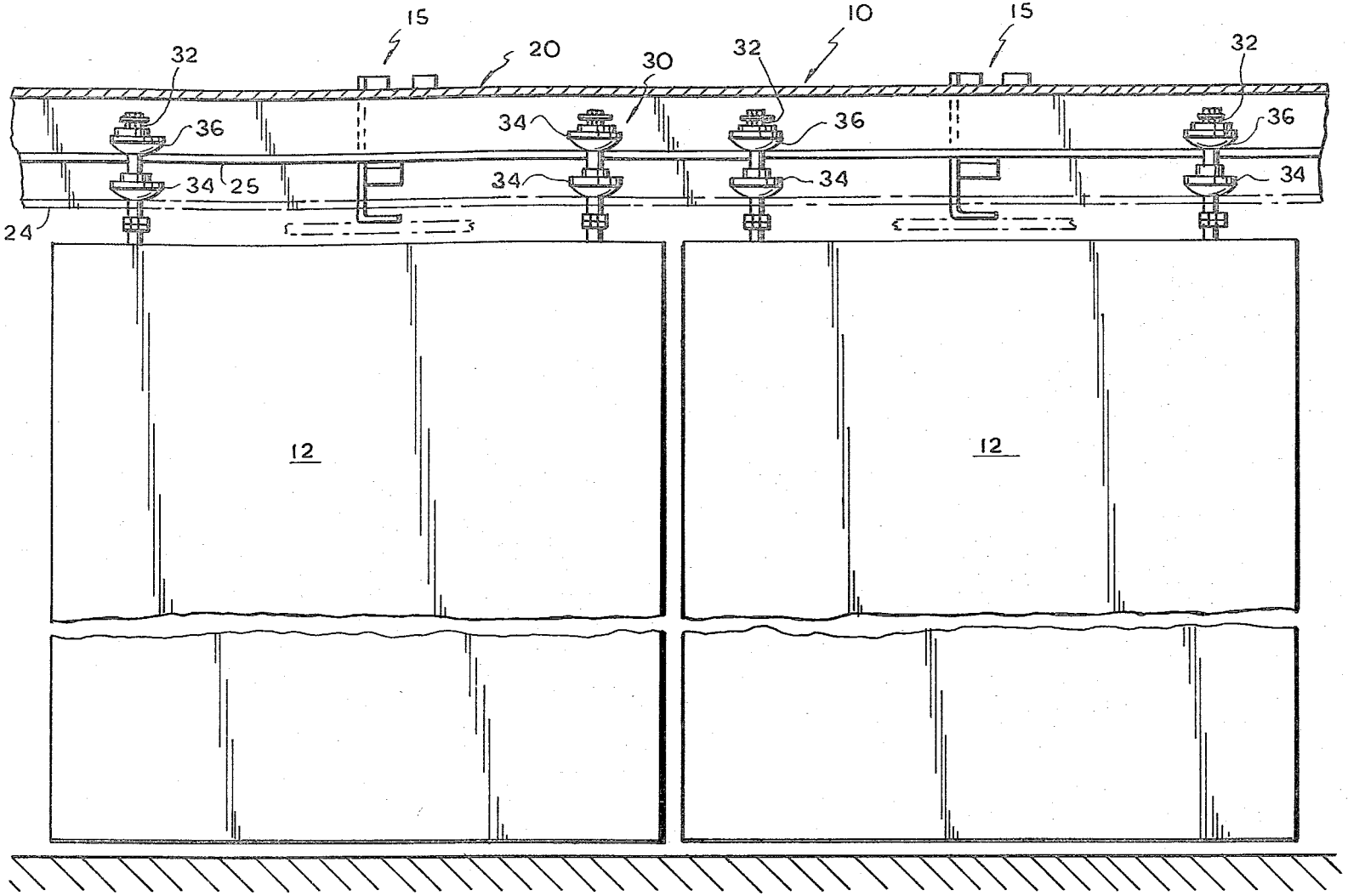
FIG. 1 is an elevational view, partly in section, illustrating the self-plumbing, counter-rotating trolley and track suspension system, operably mounted to a wall panel assembly, of the present invention.
Figure 2:
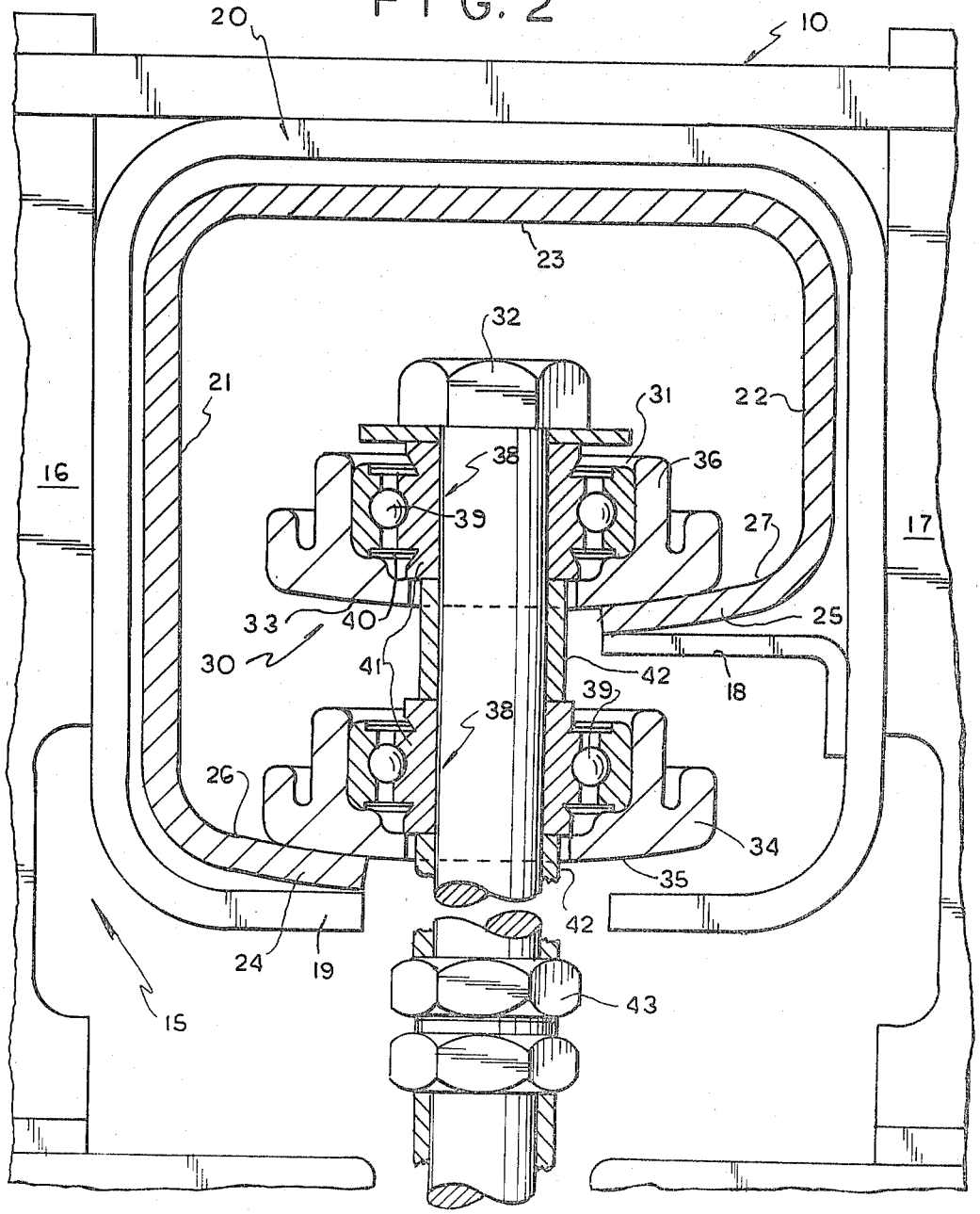
FIG. 2 is an elevational view of the counter-rotating trolley and track assembly, partly in section, mounted in operable position.

Counter-rotating trolley and track assembly 10 of the present invention is illustrated in FIG. 2 in full operable position for mounting an operable wall panel 12, as illustrated in FIG. 1.

Figure 3:
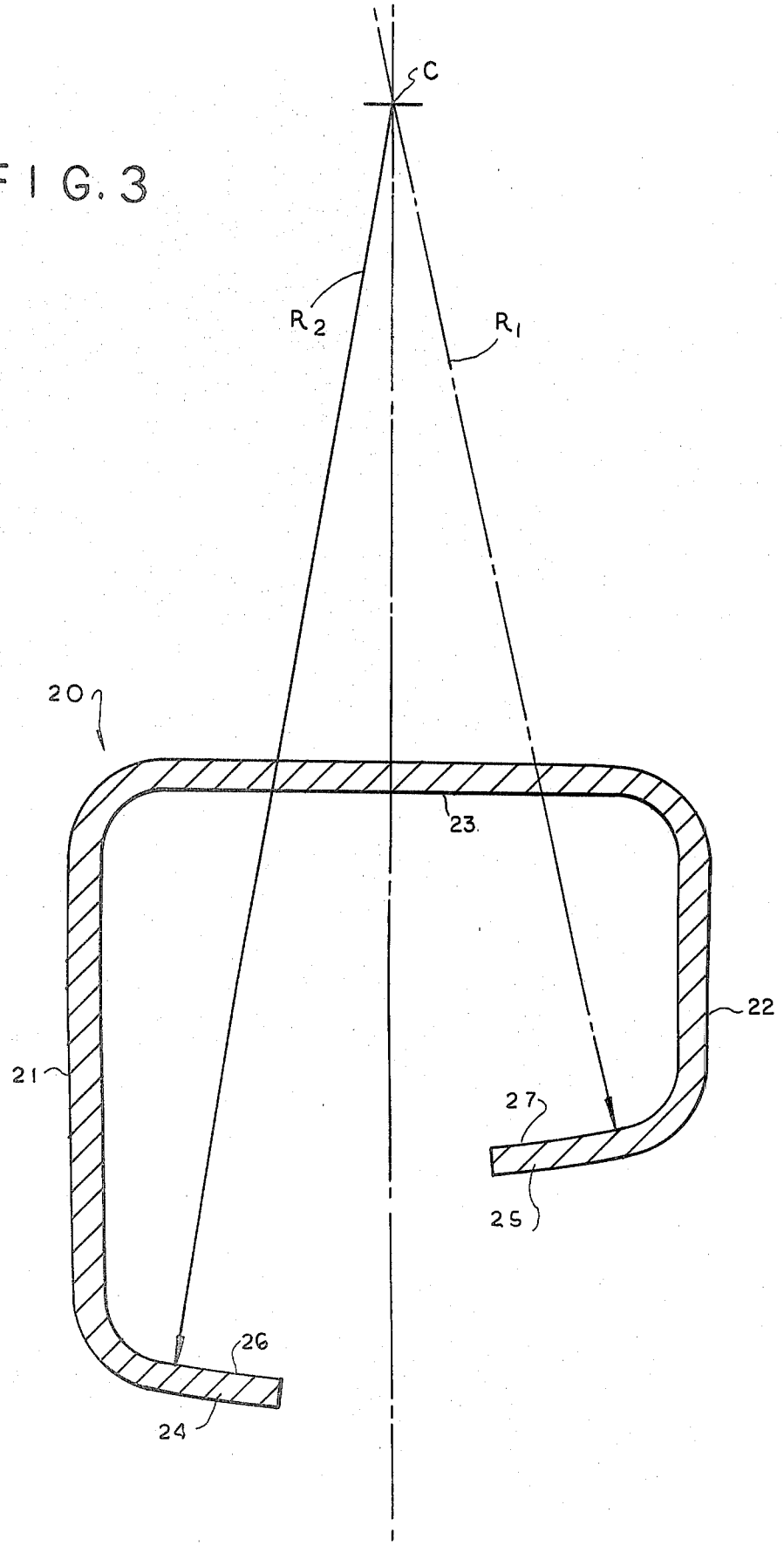
FIG. 3 is a diagramatic elevational view of the track, illustrating the radii for generating the cylindrical surfaces of the respective rails from a common centerpoint.
Figure 4:
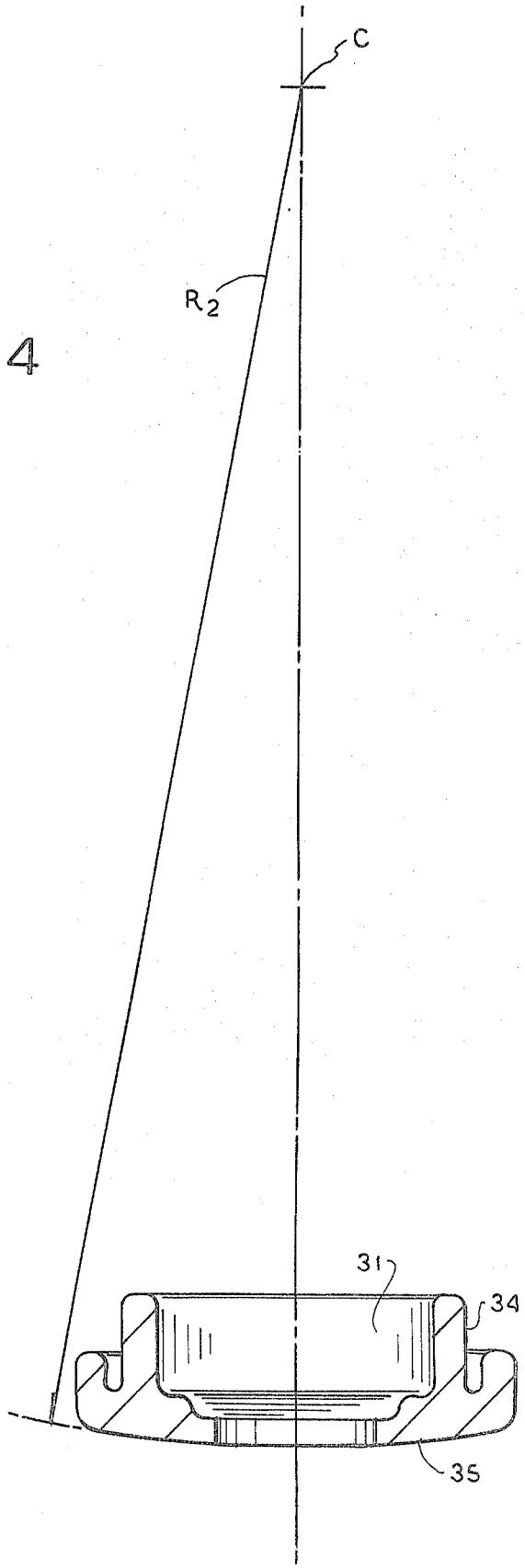
FIG. 4 is a sectional view of the lower disc, illustrating the radius for generating the spherical surface of the lower disc from the common centerpoint shown in FIG. 3.
Figure 5:
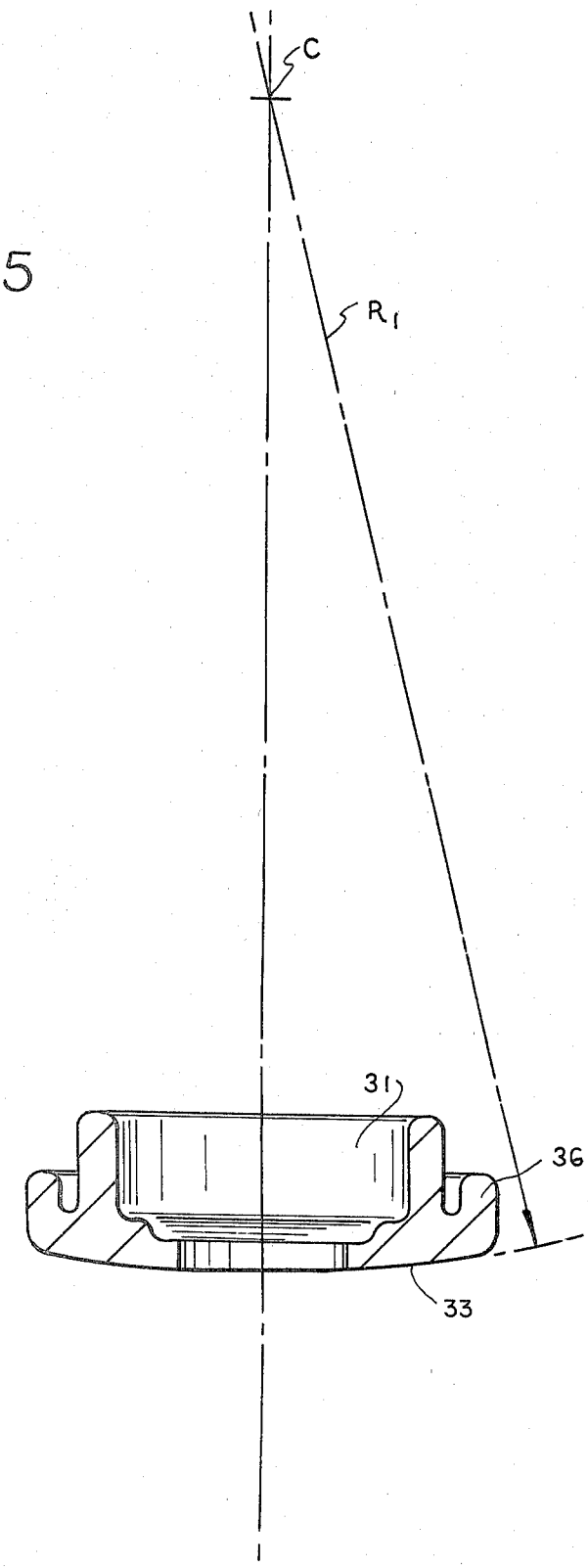
FIG. 5 is a sectional view of the upper disc, illustrating the radius for generating the spherical surface of the upper disc from the common centerpoint shown in FIG. 3.

Track 20 is made of metal and preferably formed from one sheet as by rolling with end sections turned inwardly to form diametrically arranged, parallel spaced, lower and upper rails 24, 25, respectively. Lower and upper rails 24, 25 are vertically spaced, with each rail having disc-contacting surfaces 26, 27, which are cylindrically formed with each surface generated from a common centerpoint C, but having unequal radii $R_1$, $R_2$ so that cylindrical disc-contacting surface 27 of upper rail 25 generated by radius of curvature $R_1$ is similar but not congruent to cylindrical disc-contacting surface 26 of lower rail 24 generated by radius of curvature $R_2$. Thus, radius $R_1$ of upper rail 25 is different in length from radius $R_2$ of lower rail 24, as illustrated in FIG. 3. Track assembly 20, shown in FIG. 2, also includes bracket 15, which is slidably mounted and positioned at spaced points therealong so that the track can be suspended from a ceiling structure, as illustrated in FIG. 1. Bracket 15 includes depending arms 16, 17, which provide a reinforcement of side walls 21, 22 of track 20. Each bracket 15 may be fixed in position along track 20 and centered by suitable set screws or bolts, not shown, threaded through bracket 15 against the outside surface of track 20 on top wall 22. Also, the set screws provide means for plumbing the track along its vertical axis. Hanger rods, not shown, adjust the height and horizontal plane of the track. Bracket 15 includes a clip 18 which is welded to the vertical leg of the bracket and extends parallel to the top of bracket 15. Clip 18 adds support to upper rail 25 of track 20 as does flange 19, which supports lower rail 24.

Counter-rotating trolley assembly 30 includes a pendant bolt 32, which provides a common axle for rotatably mounting lower disc 34 and upper disc 36 thereon. Each disc 34, 36 includes ball bearing assembly 38 of conventional design. Each disc 34, 36 is in the form of a spherical annular ring having a hollow center section 31 for housing ball bearing assembly 38 therein. Each ball bearing assembly 38 has a plurality of radially spaced, steel balls 39, which are retained in a ring or housing 40. Each ball bearing 39 rotates against an annular ring or race 41 which is slidably received on bolt 32 by annular bushing 42. Threaded lock nut 43 is threadedly engaged on bolt 32 and, when locked in position, places bearing assemblies 38 and annular bushings 42 in compression to lock them in place so that discs 34, 36 are held in spaced apart, vertical alignment and are free to rotate around bolt 32. When trolley 30 is fully assembled, upper and lower discs 34, 36 are spaced such that rail-contacting surface 35 of lower disc 34 will contact disc-contacting surface 26 of lower rail 24. Similarly, rail-contacting surface 33 of upper disc 36 will contact disc-contacting surface 27 of upper rail 25, as illustrated in FIG. 2.

The annular sections of discs 34, 36 may be made of any suitable metal or moldable plastic material having suitable wear characteristics; for example, a suitable plastic material may be Celcon, ®acetal copolymer or Valoz ®thermoplastic polyester.

Upper and lower discs 34, 36 are formed having rail-contacting surfaces 33, 35, respectively, that are spherically formed with each surface 33, 35 generated from a common centerpoint C so that the surfaces generated by the radii $R_1$, $R_2$ have curvatures which are similar but are not congruent.

Figure 6:
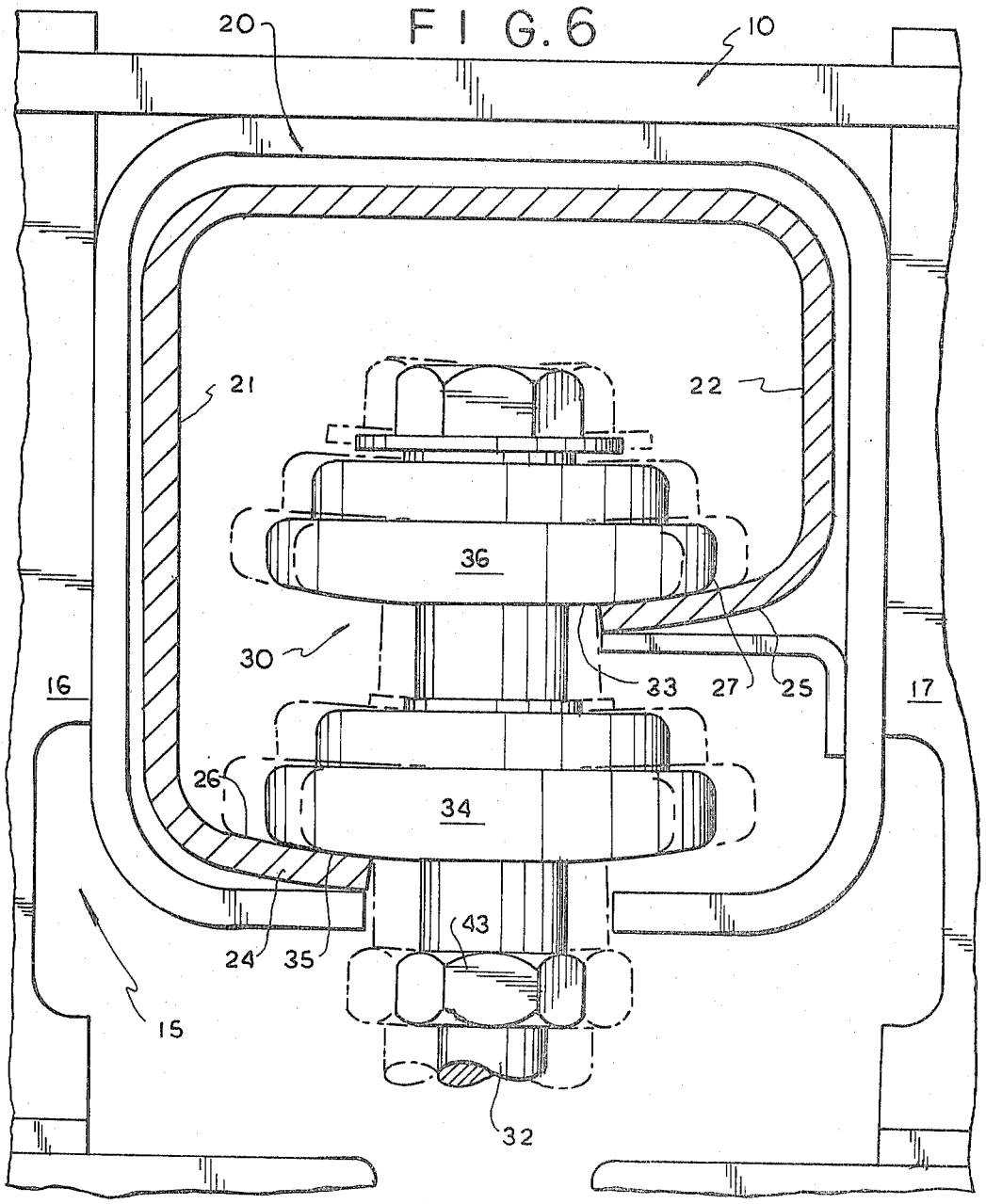
FIG. 6 is an elevational view as seen from one end of the track to illustrate the self-plumbing characteristics of the trolley with respect to the track.

The locus of points for common centerpoint C may be any point along the axial center line of trolley 30 and track 20 above rail-contacting surface 33 of upper disc 36. As radii $R_1$, $R_2$ increase in length, the surfaces generated thereby will approach but never reach a planar surface. It has been found that the cylindrical surfaces of the rail and the spherical surfaces of the disc generated from a common centerpoint which, when mated together, form, respectively, an arcuate line contact so that the shifting of the vertical axis of trolley assembly 30 with respect to the vertical axis of the track will be such that lower and upper discs 34, 36 will always remain in mating contact with lower and upper rails 24, 25. This self-plumbing characteristic of counter-rotating trolley and track assembly 10 is illustrated by the dotted lines in FIG. 6, showing the various positions of trolley assembly 30 when in misalignment with respect to the vertical axis of track 20.

In operation, track 20 is mounted to a ceiling structure and may take many forms that are conventional in the art; i.e., providing one or more wall sections to subdivide a large room into two or more rooms or enclosures. Each panel 12 is coupled to a pair of trolley assemblies 30 by bolt 32, as illustrated in FIG. 1. Thereafter, panel assemblies 12 are moved along a track path which may include various intersections to finally subdivide the large room into two or more enclosures. Should track 20, for any reason, be mounted along a ceiling structure which would cause a misalignment of its vertical axis with respect to the trolley and panel assembly, then discs 34, 36 of each trolley assembly 30 will remain in contact with their respective rails 24, 25, as illustrated in FIG. 6.

What is claimed:

1. A self-plumbing, counter-rotating trolley and track suspension system for supporting an operable wall comprising:

a counter-rotating trolley operably mounted in a track for movement therealong;

said track, including a pair of vertically spaced and diametrically formed rails, each rail having a cylindrically formed surface and each surface being generated from a common centerpoint but having unequal radii so that the surfaces generated by said respective radii have curvatures which are similar but are not congruent;

said trolley assembly having a pair of counter-rotating discs which are rotatably mounted in vertical spaced alignment on a common axle;

each of said discs having spherically formed surfaces generated from said common centerpoint whereby said contacting surfaces between said rails of said track and said counter-rotating discs of said trolley which, when mated together, make, respectively, an arcuate line contact, the respective arcs being generated from a common centerpoint but having unequal radii so that the arcs generated by the radii have curvatures which are similar but are not congruent; and said trolley assembly having means for coupling a panel thereto so that when said trolley assembly and panel are mounted, the discs of the trolley assembly will always maintain mating contact with said respective rails even when the axial center line of the trolley and track assemblies are in misalignment.

2. The counter-rotating trolley and track suspension system of claim 1 wherein said common centerpoint lies along the axial center line of said trolley and track assembly at a point above the spherical surface of the upper disc.

3. A trolley assembly having means for coupling a movable wall panel thereto for movement along a track comprising:

said trolley assembly having a pair of counter-rotating discs which are rotatably mounted in vertically spaced alignment on a common axle;

said upper disc is formed having a spherical surface generated from a centerpoint whose locus lies above said spherical surface along the axial center line of said trolley;

said lower disc is formed having a spherical surface generated from said centerpoint of said upper disc so that the radii of curvatures of said discs are unequal wherein the surfaces generated thereby are similar but not congruent; and said trolley assembly having means for mounting a movable wall panel thereto.

4. A track assembly having means for mounting said track along an overhead structure for moving an operable wall panel and trolley assembly therealong, said track comprising:

a pair of diametrically positioned rails which are vertically spaced in substantial parallel alignment to define between them a passage for the movement of a trolley assembly therealong;

said upper rail is formed having a cylindrical surface generated from a centerpoint whose locus lies above said cylindrical surface along the axial center line of said track; and said lower rail is formed having a cylindrical surface generated from said centerpoint of said upper rail so that the radii of curvatures of said rails are unequal wherein the surfaces generated thereby are similar but not congruent.

5. The track assembly, as set forth in claim 4, wherein at least one bracket is mounted along the exterior walls of said track, said bracket having a pair of depending arms positioned along each side wall of said track and each of said depending arms having means for supporting respectively said upper and lower rails of said track.

* * * * *